US006189751B1

(12) United States Patent
Tserng

(10) Patent No.: US 6,189,751 B1
(45) Date of Patent: Feb. 20, 2001

(54) HOLSTER WITH TILTING FORWARD UNLOCKING MECHANISM

(75) Inventor: Miin-Horng Tserng, Taipei (TW)

(73) Assignee: Exquisite Plastic Model Co., Ltd., Taipei (TW)

( * ) Notice: Under 35 U.S.C. 154(b), the term of this patent shall be extended for 0 days.

(21) Appl. No.: 09/409,227

(22) Filed: Sep. 30, 1999

(51) Int. Cl.[7] ..... F41C 33/02

(52) U.S. Cl. ..... 224/244; 224/195; 224/198; 224/240; 224/243; 224/912

(58) Field of Search ..... 224/244, 198, 224/197, 195, 193, 243, 240, 911, 912, 914

(56) References Cited

U.S. PATENT DOCUMENTS 5,167,355 * 12/1992 Hill ..... 224/193
5,284,281 * 2/1994 Nichols ..... 224/244

* cited by examiner

*Primary Examiner*—Stephen K. Cronin
*Assistant Examiner*—Maerena W. Brevard
(74) *Attorney, Agent, or Firm*—A & J

(57) ABSTRACT

A holster with tilting forward unlocking mechanism is disclosed wherein wearer must unfasten a strap first and then tilt holster forward in order to cause a locking element to retract into a trigger guard restraining device so as to permit a handgun to freely remove from the holster.

2 Claims, 6 Drawing Sheets

HOLSTER WITH TILTING FORWARD UNLOCKING MECHANISM

FIELD OF THE INVENTION

The present invention relates to a handgun holster, and more particularly to a handgun holster with tilting forward unlocking mechanism.

BACKGROUND OF THE INVENTION

Conventionally, a law enforcement officer usually wears a handgun in patrol. And in most cases officer wears the handgun in his/her waist. However, the only device for prevention of robbery of the handgun is a strap equipped with a buckle or the like. Obviously, it is not enough and thus instances of fugitive successfully removes handgun from its holster occurs. In order to solve the above problem, a holster equipped with a locking mechanism for prevention the extraction of handgun from the holster by another party other than the law enforcement officer is disclosed by a prior art as detailed below.

A user must tilt holster backward in order to remove a handgun from a conventional holster A equipped with above locking mechanism as shown in FIG. 1. But this is unsatisfactory for the following reasons:

1) Not ergonomical because handgun backward tilting does not conform to the response of law enforcement officer to a critical circumstance.
2) Backward tilting for extracting handgun will easily cause the handgun in a dangerous position, i.e., handgun is possible of being withdrawn by fugitive from behind.
3) The speed for removing handgun is relatively low and even worse handgun may not be removed in a critical situation due to caught in the holster.

Thus, it is desirable to provide a holster with tilting forward unlocking mechanism in order to overcome the above drawbacks of prior art.

SUMMARY OF THE INVENTION

It is an object of the present invention to provide a holster with tilting forward unlocking mechanism wherein a wearer must unfasten a strap first and then tilt holster forward in order to cause a locking element to retract into a trigger guard restraining device so as to permit a handgun to freely remove from the holster.

The above and other objects, features and advantages of the present invention will become apparent from the following detailed description taken with the accompanying drawings.

DETAILED DESCRIPTION OF THE PREFERRED EMBODIMENTS

Figure 1:
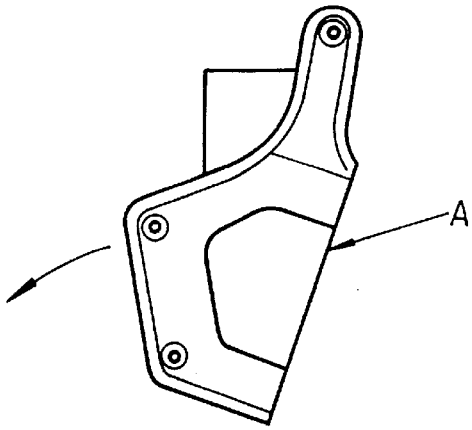
PRIOR ART FIG. 1
FIG. 1 is a front view of a prior art backward tilting handgun holster.
Figure 2:
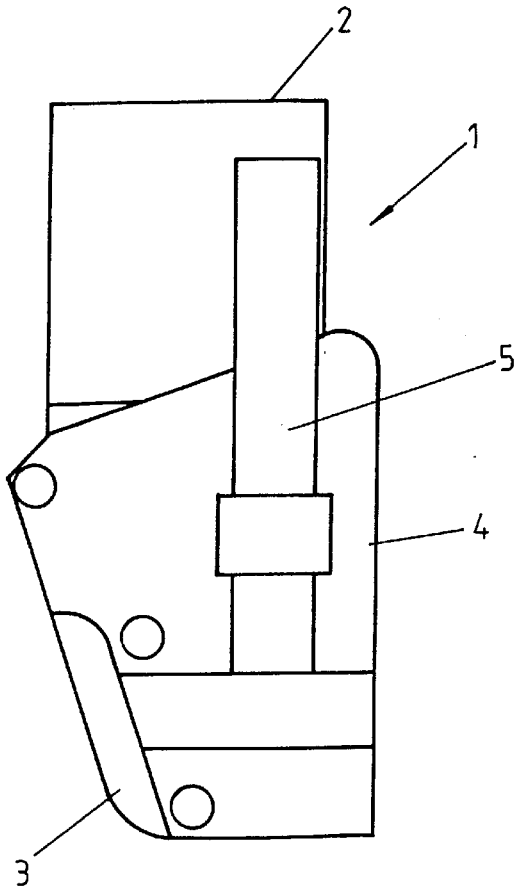
FIG. 2 is a front view of a holster with tilting forward unlocking mechanism of a preferred embodiment of the invention.
Figure 3:
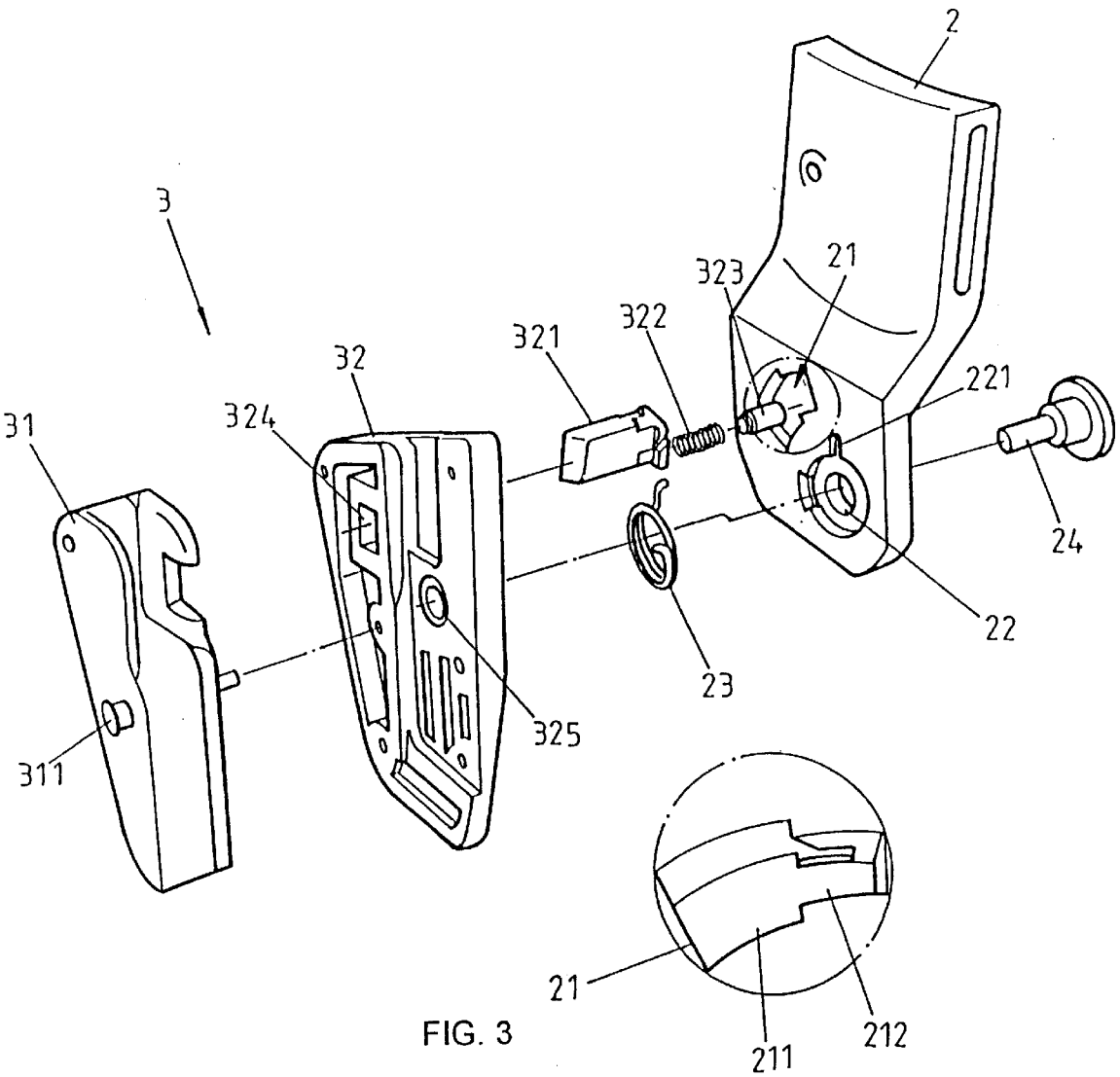
FIG. 3 is an exploded view of a trigger guard restraining device of the invention.
Figure 4A:
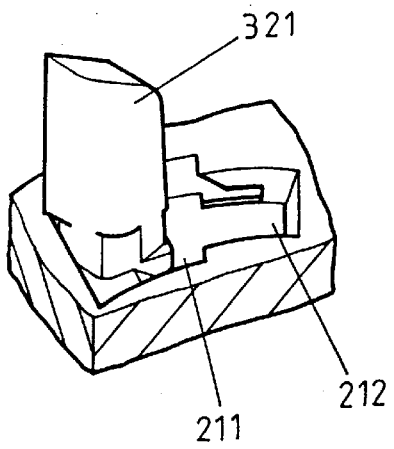
FIGS. 4A–4C are views illustrating the attachment of components of trigger guard restraining device in a locked position respectively.
Figure 4B:
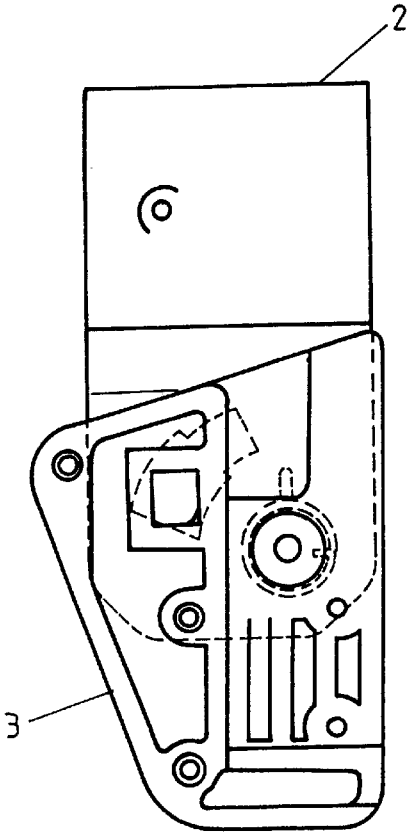
Figure 4C:
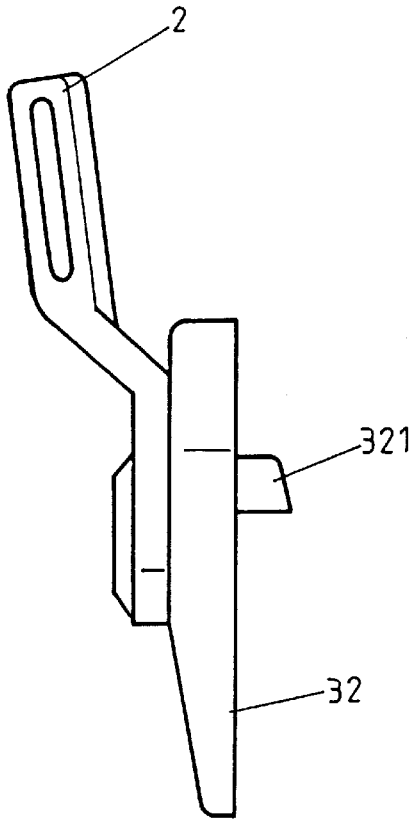
Figure 5A:
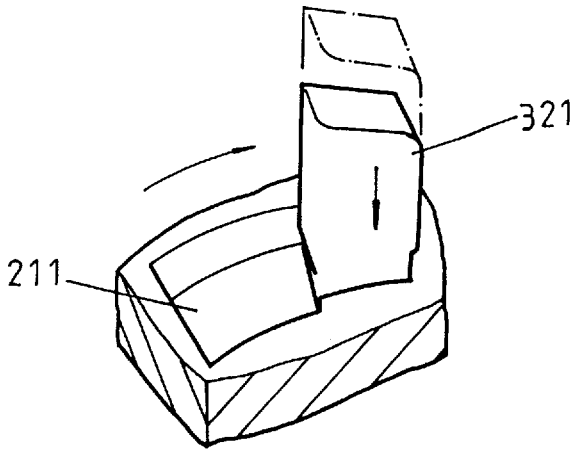
FIGS. 5A–5C are views illustrating the attachment of components of FIGS. 4A–4C in an unlocked position respectively.
Figure 5B:
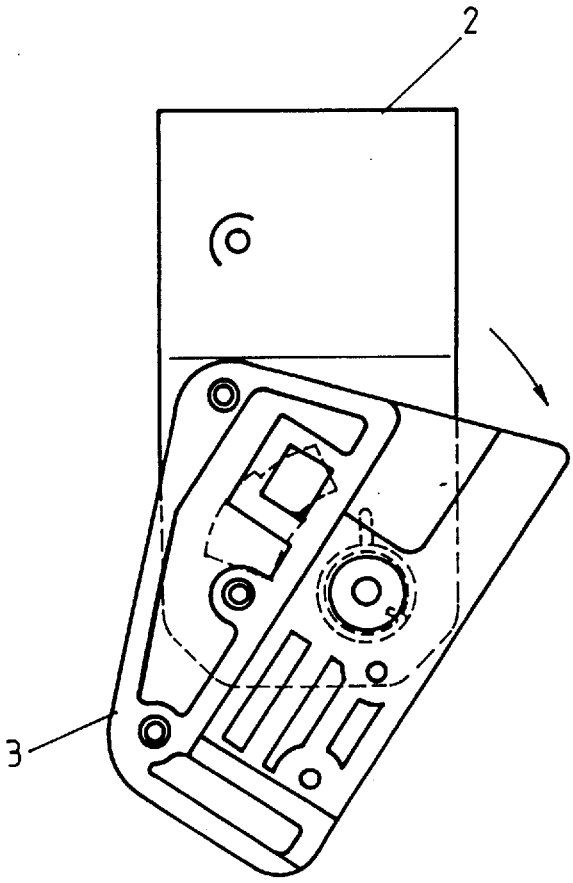
Figure 5C:
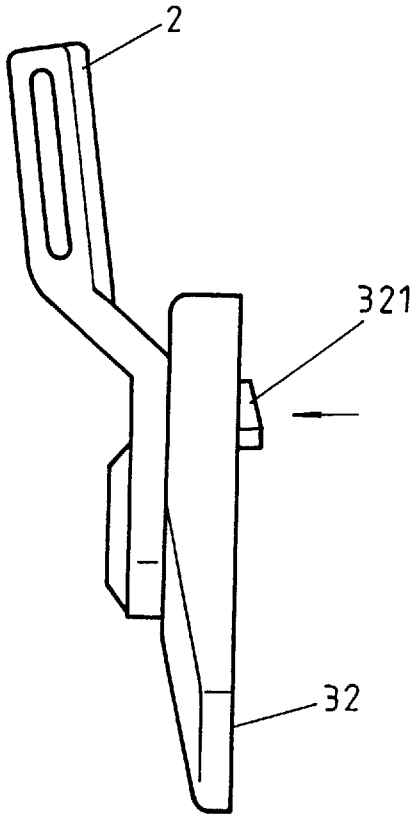

Referring to FIG. 2, there is shown a holster system 1 a preferred embodiment of the invention comprising a trigger guard restraining device consisting of loop 2 and holster body 3, a holster 4, and a strap 5 wherein lower portion of loop 2 is pivotably attached to holster body 3 (as detailed in the description of FIGS. 3–5). Belt (not shown) passes through loop 2 and around the waist of user. A number of fasteners such as bolts, rivets or the like pass through the corresponding number of holes on the holster body 3 to secure holster 4 to the holster body 3. The size of holster 4 is suitable to receive a handgun. Strap 5 may fasten the handgun inserted in the holster 4 by means of a buckle or the like which is apparent to those skilled in the art.

Referring to FIGS. 3–5, holster body 3 comprises a first member 31 for receiving trigger guard and muzzle, and a second member 32 including an elongate hollow locking element 321, a first helical spring 322, a short hollow cylindrical member 323, an opening 324, and an aperture 325 wherein first spring 322 is received in cylindrical member 323 which in turn receives in locking element 321 such that one end of locking element 321 is engaged with a larger space 211 of a cavity 21 of loop 2, while the other end of locking element 321 is inserted through and protruded from opening 324 and further caught within the space between trigger guard and handgun body in a first operative position by the expansion of first spring 322. In other words, it is difficult and even impossible to remove handgun from holster 4 in such a position (i.e., a locked state).

Loop 2 further comprises a hole 22, a second helical spring 23, and a fastener (e.g., nut) 24 wherein one end of second spring 23 is firmly seated in a U-shaped opening 221 protruded from a periphery of hole 22; nut 24 passes through hole 22, second spring 23, and aperture 325 to secure to a fastener 311.

When a user inserts his/or finger in the trigger guard and applies a sufficient force on the handgun to tilt the holster 4 forward, second spring 23 will pivotably rotate a limited distance which in turn forces locking element 321 to move from larger space 211 to smaller space 212 which is recessed deeper than the larger space 211, i.e., one end of locking element 321 is engaged against the bottom of smaller space 212 and thus the other end of locking element 32 is retracted to a position being flush with the opening 324, thereby unlocking the handgun (i.e., in a second operative position).

Figure 6:
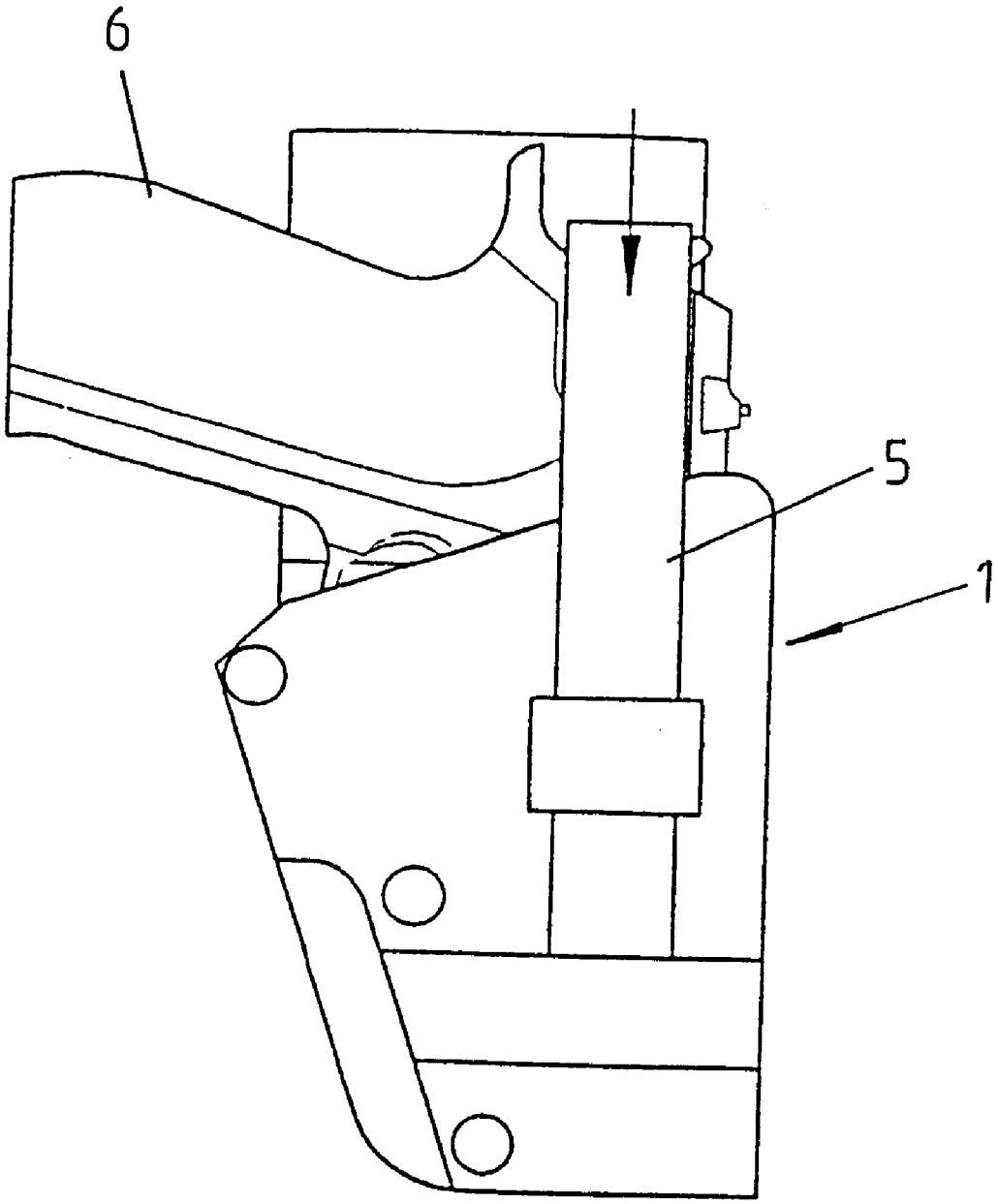
FIG. 6 is a front view showing handgun inserted in the holster and locked in place.
Figure 7:
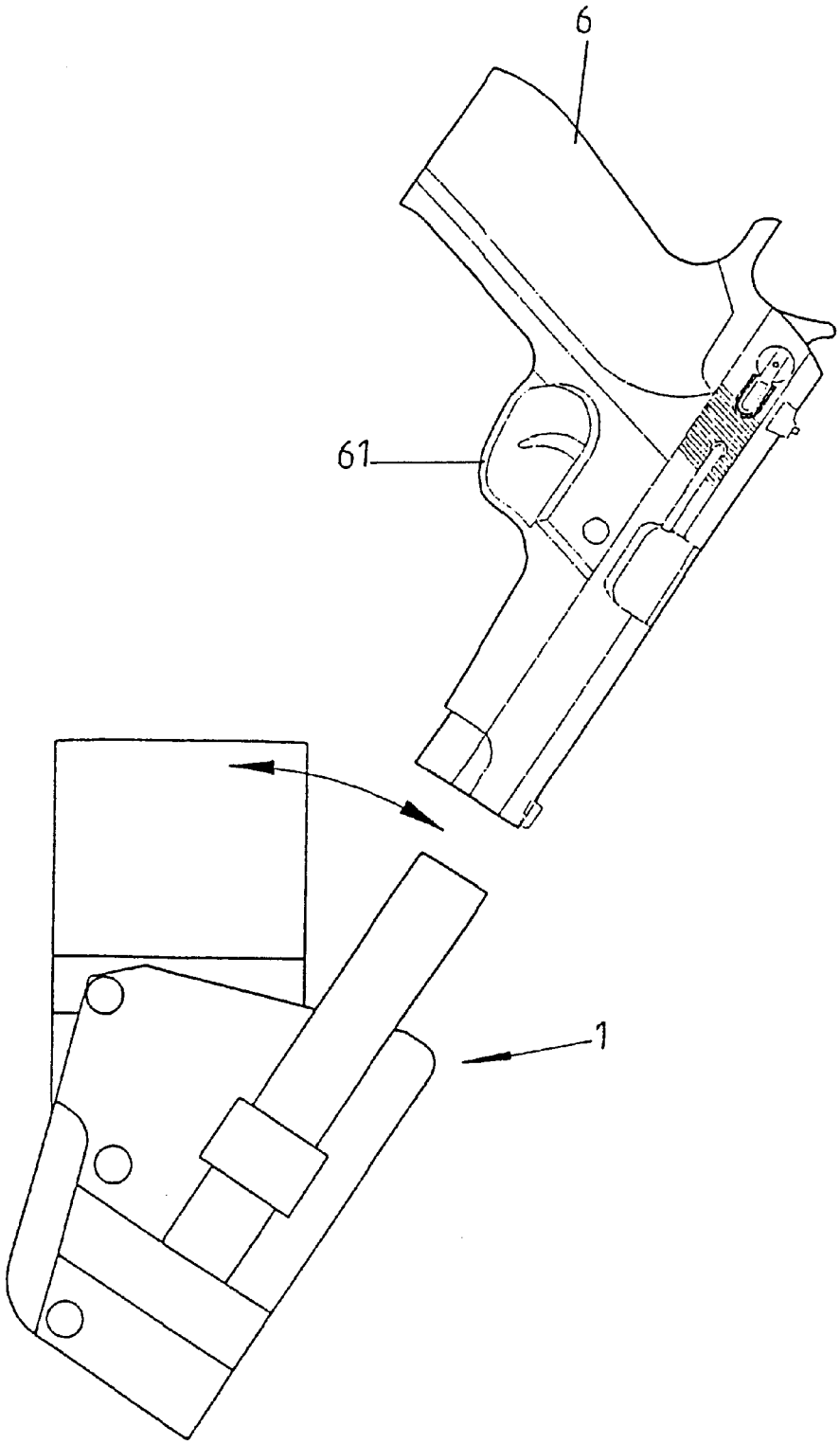
FIG. 7 is a front view showing strap is unfastened and handgun is removed from holster when user applies a force to tilt the holster forward.

Referring to FIGS. 6–7, for example in a critical circumstance, a user (e.g., law enforcement officer) must unfasten strap 5 first and then tilt holster 4 forward in order to cause locking element 321 to retract from trigger guard 61 so as to permit a handgun 6 to freely remove from the holster 4 (FIG. 7).

While the invention herein disclosed has been described by means of specific embodiments, numerous modifications and variations could be made thereto by those skilled in the art without departing from the scope of the invention set forth in the claims.

What is claimed is:

1. A handgun holster with a tilting forward unlocking mechanism comprising:

a loop including a cavity having a first space and a second space deeper than the first space, a hole having a U-shaped recess protruded from a periphery thereof, a second spring, and a fastener;

a body having a first member in combination with the holster for receiving a trigger guard and a muzzle of a handgun, and a second member including a hollow locking element, a first spring, a hollow cylindrical member, an opening, and an aperture; and a strap for releasably securing the handgun;

wherein one end of the second spring is firmly seated in the U-shaped recess; the fastener passes through the hole, the second spring, and the aperture to secure to the first member; the first spring is received in the hollow cylindrical member which in turn is received in the hollow locking element such that one end of the hollow locking element is engaged with the first space, and the other end of the locking element is inserted through and protruded from the opening for being caught in the trigger guard in a first operative position by an expansion of the first spring; and the second spring pivotably rotates a predetermined distance when the holster is tilted forward which in turn forces one end of the hollow locking element to move from the first space to the second space and the other end of the hollow locking element to retract to a position being flush with the opening, thereby unlocking the handgun in a second operative position.

2. The holster of claim 1, wherein the first member comprises a fastener in cooperation with the fastener of the second member for securing the first and the second members together.

* * * * *